US007458921B2

(12) United States Patent
Hallar

(10) Patent No.: US 7,458,921 B2
(45) Date of Patent: Dec. 2, 2008

(54) HAND WEIGHT WITH STRAP

(75) Inventor: James Hallar, Minneapolis, MN (US)

(73) Assignee: Target Brands, Inc., Minneapolis, MN (US)

( * ) Notice: Subject to any disclaimer, the term of this patent is extended or adjusted under 35 U.S.C. 154(b) by 0 days.

(21) Appl. No.: 11/324,925

(22) Filed: Jan. 4, 2006

(65) Prior Publication Data

US 2007/0155599 A1 Jul. 5, 2007

(51) Int. Cl.
*A63B 21/072* (2006.01)
*A63B 21/075* (2006.01)

(52) U.S. Cl. ..... 482/106; 482/108; 482/139

(58) Field of Classification Search ..... 272/109; 273/84 R; D21/117, 681, 682, 684; 482/139
See application file for complete search history.

(56) References Cited

U.S. PATENT DOCUMENTS 3,116,947 A 1/1964 Brownrigg
4,351,526 A * 9/1982 Schwartz ..... 482/108
4,361,324 A * 11/1982 Baroi ..... 482/108
D273,030 S 3/1984 Anderson
D280,337 S * 8/1985 Hood ..... D21/682
4,538,806 A * 9/1985 Wilkerson ..... 482/108
4,627,618 A * 12/1986 Schwartz ..... 482/108
4,720,098 A 1/1988 Gordon
4,724,971 A 2/1988 Henline
4,743,017 A 5/1988 Jaeger
D297,751 S 9/1988 Brown
D297,962 S * 10/1988 Wu ..... D21/682
4,778,173 A 10/1988 Joutras
4,801,137 A * 1/1989 Douglass ..... 482/82
D307,168 S 4/1990 Vodhanel
4,913,422 A * 4/1990 Elmore et al. ..... 482/106
5,033,740 A * 7/1991 Schwartz et al. ..... 482/105
D321,230 S 10/1991 Leonesio
5,056,778 A * 10/1991 Hull et al. ..... 482/105
5,086,377 A * 2/1992 Roberts ..... 362/102
5,102,123 A * 4/1992 Roark ..... 482/105
D326,298 S 5/1992 King et al.
D326,300 S 5/1992 King et al.
5,135,455 A * 8/1992 King et al. ..... 482/108
5,180,352 A * 1/1993 Sreter ..... 482/108
5,242,348 A * 9/1993 Bates ..... 482/105
5,242,350 A 9/1993 Chang
D343,433 S * 1/1994 Crosson ..... D21/682
5,325,997 A 7/1994 Washington et al.
D352,981 S 11/1994 Ko
5,393,285 A * 2/1995 Fischer et al. ..... 482/108
D359,090 S 6/1995 Van Der Hoeven
5,428,514 A * 6/1995 Fink, Jr. ..... 362/183

(Continued)

FOREIGN PATENT DOCUMENTS

JP 05137815 A * 6/1993

*Primary Examiner*—Loan H Thanh
*Assistant Examiner*—Sandhara M Ganesan
(74) *Attorney, Agent, or Firm*—Faegre & Benson LLP

(57) ABSTRACT

Dumbbell assemblies and methods of making and using dumbbell assemblies are disclosed. The dumbbell assembly includes a dumbbell and a strap. The dumbbell includes a handle, a first end weight, and a second end weight. The strap includes a central band, a first coupling portion, and a second coupling portion. The first coupling portion is elastically secured about the first end weight and the second coupling portion is elastically secured about the second end weight.

20 Claims, 6 Drawing Sheets

U.S. PATENT DOCUMENTS 5,464,379 A * 11/1995 Zarecky ..... 482/108
5,531,657 A * 7/1996 Macedo ..... 482/111
D372,945 S 8/1996 Morgan
5,556,003 A * 9/1996 Johnson et al. ..... 222/39
5,575,555 A * 11/1996 Chang ..... 362/109
D384,713 S 10/1997 Eckmann
5,749,490 A 5/1998 Keicher
D399,910 S 10/1998 Eckmann
5,823,922 A 10/1998 Eckmann
5,857,946 A * 1/1999 Brown ..... 482/108
D413,800 S 9/1999 Caparros et al.
5,957,515 A * 9/1999 Van Der Sluys ..... 294/25
6,000,066 A * 12/1999 Williams ..... 2/422
6,062,448 A * 5/2000 Balodis ..... 224/257
6,076,297 A * 6/2000 Lippincott ..... 43/44.87
6,146,319 A * 11/2000 Tarail ..... 482/139
6,336,894 B1 * 1/2002 Kestila ..... 482/99
D458,800 S * 6/2002 Kotsonis ..... D7/393
D458,846 S 6/2002 Writt, Sr.
6,544,150 B1 * 4/2003 Samodoumov ..... 482/93
D494,233 S * 8/2004 Kerry ..... D21/662
6,916,104 B2 * 7/2005 Parsons et al. ..... 362/191
7,014,333 B2 * 3/2006 Tatebe ..... 362/191
D522,752 S * 6/2006 Brown et al. ..... D3/316
2005/0137064 A1 * 6/2005 Nothnagle ..... 482/108
2005/0239617 A1 * 10/2005 Tenaglia ..... 482/122
2006/0162193 A1 * 7/2006 Jones et al. ..... 36/136

* cited by examiner

HAND WEIGHT WITH STRAP

BACKGROUND OF THE INVENTION

The health and fitness industry has undergone explosive growth as people have increasingly realized the importance of healthy living and exercise. Along with improving their diets, people have become more and more motivated to engage in regular exercise and fitness training. Weight lifting, sometimes termed "resistance training," is a popular type of exercise. Weights and weight lifting are also incorporated, for example, into walking routines or other exercise formats, such as aerobic exercises or stretching exercises.

Weights and weight training programs have not only grown in popularity, but have also grown in variety. Dumbbells are one common variety of weight widely used throughout homes and gyms. While the basic concept of the dumbbell has long been understood and used as a reliable and functional base design, improvements remain to be made in dumbbell design and methods of exercising with dumbbell equipment in order to provide an overall better workout experience.

SUMMARY OF THE INVENTION

Some aspects of the present invention relate to a dumbbell assembly including a dumbbell and a strap. The dumbbell includes a handle, a first end weight, and a second end weight. The handle is substantially elongate and defines a first end portion and a second end portion opposing the first end portion. The handle also defines a maximum diameter. The first end weight is connected to the first end portion of the handle. The first end weight defines a maximum diameter greater than the maximum diameter of the handle. In turn, the second end weight is connected to the second end portion of the handle. The second end weight also defines a maximum diameter greater than the maximum diameter of the handle. The strap includes a central band, a first coupling portion, and a second coupling portion. The central band defines a first end portion and a second end portion opposing the first end portion. The first coupling portion is connected to the first end portion of the central band. The second coupling portion is connected to the second end portion of the central band. Furthermore, the first coupling portion is elastically secured about the first end weight and the second coupling portion is elastically secured about the second end weight.

While some aspects of the invention have been described above, other related products and methods are also disclosed and provide additional advantages.

BRIEF DESCRIPTION OF THE DRAWINGS

Embodiments of the invention will be described with respect to the figures, in which like reference numerals denote like elements, and in which.

DETAILED DESCRIPTION

In the following detailed description, reference is made to the accompanying drawings which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments of the present invention can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1B:
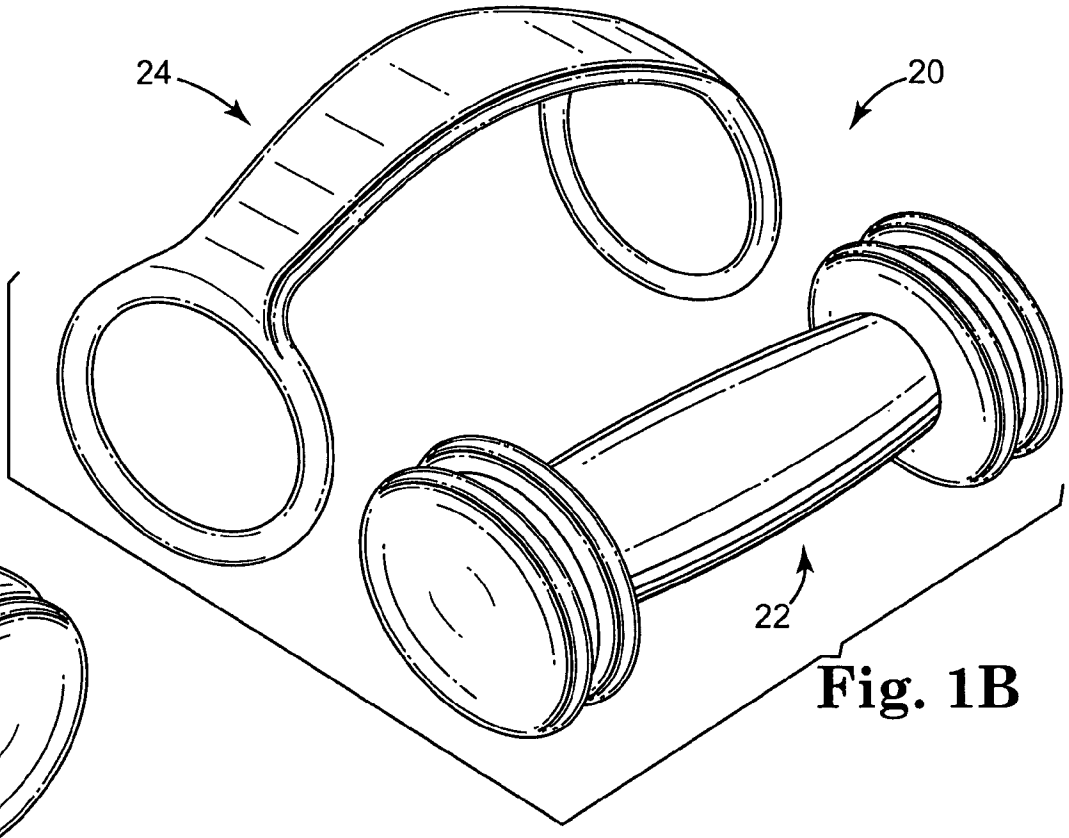
FIGS. 1A and 1B are perspective views of a dumbbell assembly, according to an embodiment of the present invention.
Figure 1A:
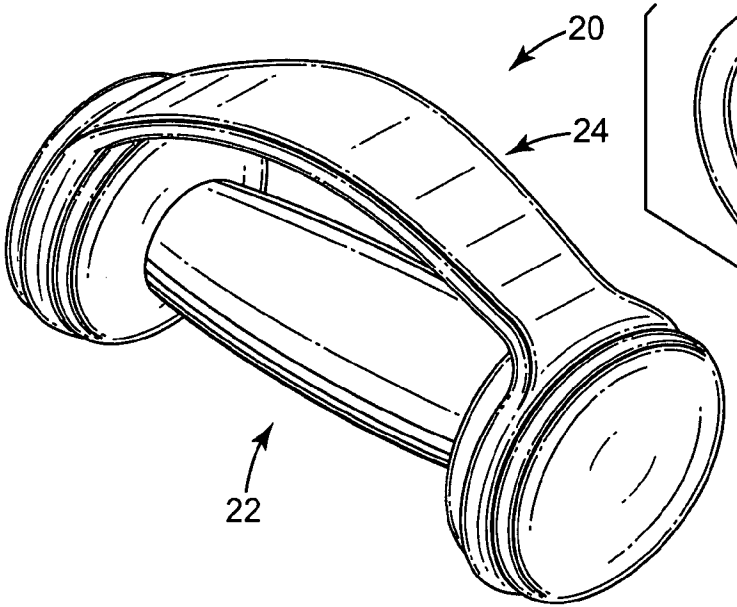

FIGS. 1A and 1B show a dumbbell assembly 20, which is otherwise described as a hand weight assembly or a hand held exercise implement, for example. Generally speaking, the dumbbell assembly 20 includes a dumbbell 22, or hand weight, and a strap 24, or hand band. In operation, a user (not shown) grasps the dumbbell 22 in a palm of a hand with the strap 24 about a back of the hand.

Figure 2:
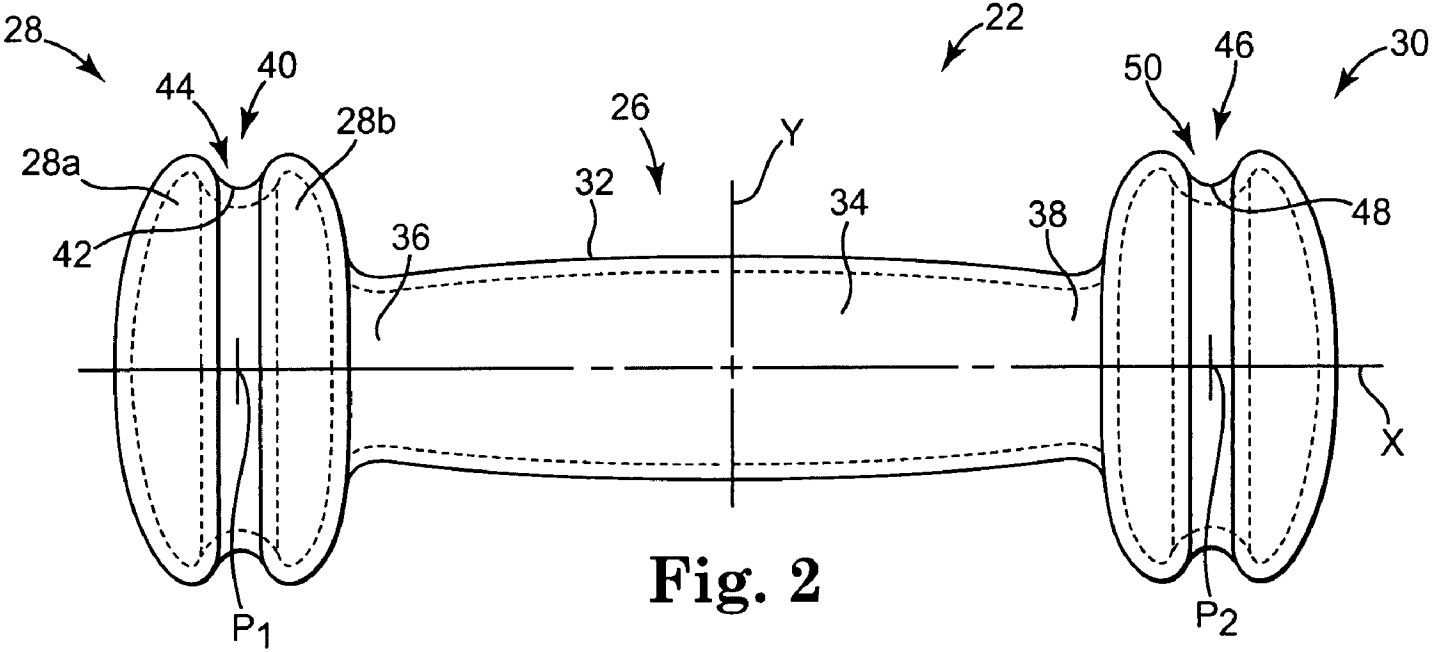
FIG. 2 is a front view of a dumbbell of the dumbbell assembly of FIG. 1A and 1B, according to an embodiment of the present invention.

FIG. 2 shows the dumbbell 22 from a front view. The dumbbell 22 defines a longitudinal centerline X and a transverse midline Y. As shown in dotted lines, the dumbbell 22 includes a handle 26, or bar, extending between a first end weight 28, or first lobe, and a second, opposing end weight 30, or second lobe. The dumbbell 22 also includes an optional outer coating 32. The dumbbell 22 is continuously formed such that the handle 26 fluidly transitions to the first end weight 28 and the second end weight 30. In particular, the dumbbell 22 is formed as a single, substantially continuous piece. The outer coating 32 is also substantially continuously formed about the handle 26 and the first and second end weights 28, 30. The coating 32 is substantially form-fitting and follows an outer profile of the handle 26 and the first and second end weights 28, 30. In this manner, the dumbbell 22 defines a substantially unitary or monolithic structure.

In combination with the outer coating 32, the handle 26 is substantially elongate and defines a middle portion 34, a first end portion 36 connected to the first end weight 28, and a second end portion 38 connected to the second end weight 30. The middle portion 34 necks, or tapers in diameter from the transverse midline Y toward the first and second end portions 36, 38. In this manner, the middle portion 34 defines a substantially convexo-convex shaped front profile extending along the longitudinal centerline X. Additionally, each of the first and second end portions 36, 38 is substantially rounded, smoothly transitioning between the middle portion 34 and the first and second end weights 28, 30, respectively.

Figure 3:
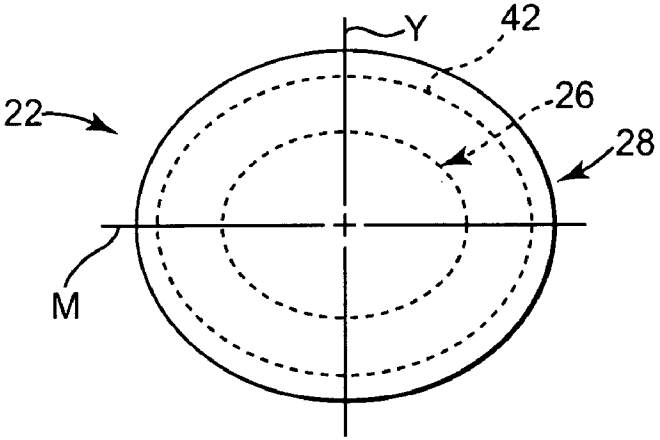
FIG. 3 is a side view of the dumbbell of FIG. 2, according to an embodiment of the present invention.

As designated generally by dotted lines in FIG. 3, the handle 26 defines a substantially oval-shaped side profile. In particular, each of the middle portion 34, the first end portion 36, and the second end portion 38 defines substantially oval-shaped side profiles, though differently sized. The handle 26 optionally defines a substantially circular-shaped side profile (not shown), with some or all of each of the middle portion 34, the first end portion 36, and the second end portion 38 defining circular-shaped side profiles (not shown). The middle portion 34 of the handle 26 defines a maximum outer diameter of the handle 26, at the transverse midline Y. Where the handle 26 defines a substantially oval-shaped side profile, the maximum outer diameter resides on a major axis M.

With reference back to FIG. 2, in combination with the outer coating 32, the first end weight 28 defines a midpoint $P_1$ and a substantially oval-shaped front profile having an outer circumference that includes portions 28*a*, 28*b* as viewed in FIG. 2. The first end weight 28 has a substantially annular groove 40 formed in the outer circumference of the first end weight 28 at the midpoint $P_1$ . The groove 40 divides the first end weight 28 into an outer portion 28*a* and an inner portion 28*b* and defines a base 42 and a mouth 44. The base 42 is substantially curved, or rounded. The mouth 44 is rounded and defines a substantially curved, or rounded transition from the inner and outer portions 28*a* , 28*b* into the groove 40. With reference to FIG. 3, the first end weight 28 defines a substantially oval-shaped side profile, having a maximum outer diameter residing along the major axis M. In particular, the maximum outer diameter is defined by the outer and/or inner portions 28*a*, 28*b*. The first end weight 28 optionally defines a substantially circular-shaped side profile, for example, with the outer and/or inner portions 28*a*, 28*b* defining the circular-shaped side profile. The maximum outer diameter of the first end weight 28 is greater than the maximum outer diameter of the handle 26. In this manner, the first end weight 28 defines an exaggerated transverse profile or shape relative to the handle 26. Where the first end weight 28 defines a substantially oval-shaped side profile, the maximum outer diameter resides on the major axis M.

With reference back to FIG. 2, in combination with the outer coating 32, the second end weight 30 defines a midpoint $P_2$ and a substantially oval-shaped front profile having an outer circumference. The second end weight 30 has a substantially annular groove 46 formed in the outer circumference of the second end weight 30 at the midpoint $P_2$ . The groove 46 divides the second end weight 30 into an outer portion 30*a* and an inner portion 30*b* and defines a base 48 and a mouth 50. The base 48 is substantially curved, or rounded. The mouth 50 defines a substantially curved, or rounded transition from the inner and outer portions 30*a*, 30*b* to the groove 46. With reference to FIG. 3, though obscured by the first end weight 28, the second end weight 30 defines a substantially oval-shaped side profile having a maximum outer diameter at the outer and inner portions 30*a*, 30*b*.

The second end weight 30, including the outer and/or inner portions 30*a*, 30*b*, optionally defines a substantially circular-shaped side profile, for example. The maximum outer diameter of the second end weight 30 is greater than the maximum outer diameter of the handle 26. In this manner, the first end weight 28 defines an exaggerated transverse profile or shape relative to the handle 26. Where the second end weight 30 defines a substantially oval-shaped side profile, the maximum outer diameter resides on the major axis M.

The handle 26, first end weight 28, and second end weight 30 are formed of a relatively heavy material, such as cast iron. Various methods of continuously manufacturing a solid piece of cast iron, or a cast-iron billet, are optionally applied, including sand molding methods. The outer coating 32 is formed of a substantially compliant and graspable material, for example neoprene rubber. Various methods of forming a substantially continuous coating of substantially compliant material are contemplated, including dipping methods.

Figure 4:
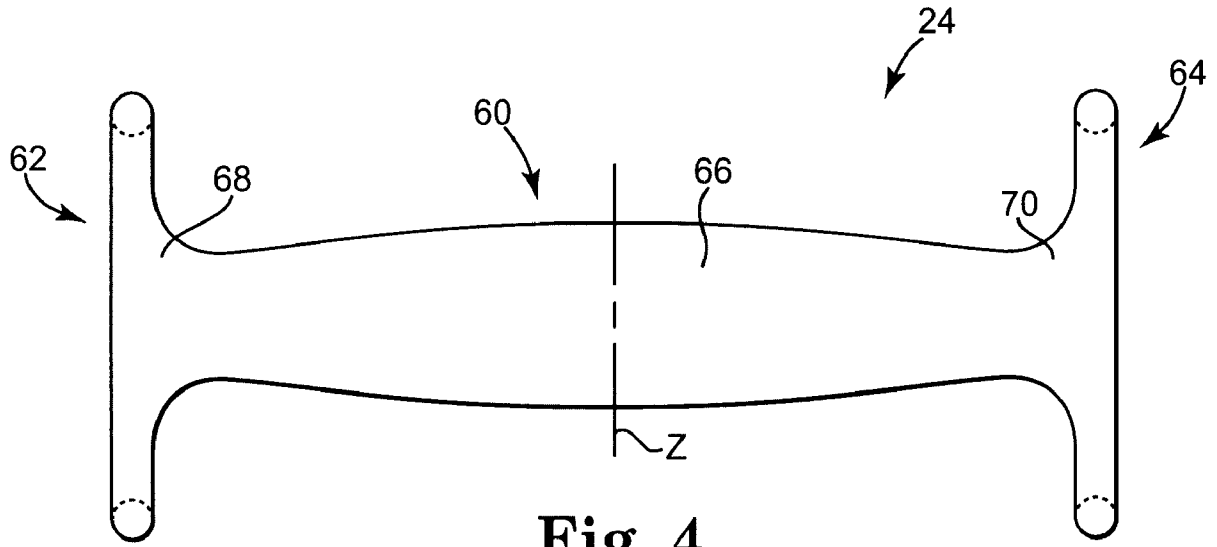
FIG. 4 is a top view of a strap of the dumbbell assembly of FIGS. 1A and 1B, according to an embodiment of the present invention.

FIG. 4 shows the strap 24 from a top view. The strap 24 defines a transverse midline Z and includes a central band 60, or central portion, extending between a first coupling portion 62, or a first deformable cuff, and an opposing, second coupling portion 64, or second deformable cuff. The strap 24 is continuously formed such that the central band 60 fluidly transitions to the first and second coupling portions 62, 64, respectively. In particular, the strap 24 is formed as a single, substantially continuous piece. The strap 24 is formed of a substantially compliant and elastically deformable material, for example silicone, sanoprene, or thermoplastic rubbers generally.

The central band 60 defines a mid portion 66, a first end portion 68, and a second end portion 70. The mid portion 66 is substantially elongate and necks, or tapers in width, from the transverse midline Z toward the first and second coupling portions 62, 64, respectively. In this manner, the central band 60 defines a substantially convexo-convex shaped top profile extending orthogonally to the transverse midline Z. Additionally, the central band 60 transitions smoothly to the first and second coupling portions 62, 64, respectively at the first and second end portions 68, 70. In particular, a first end portion 68 and a second end portion 70 are substantially rounded and connected to the end portions 62, 64 such that the central band 60 smoothly transitions to the first and second coupling portions 62, 64, respectively.

Figure 5:
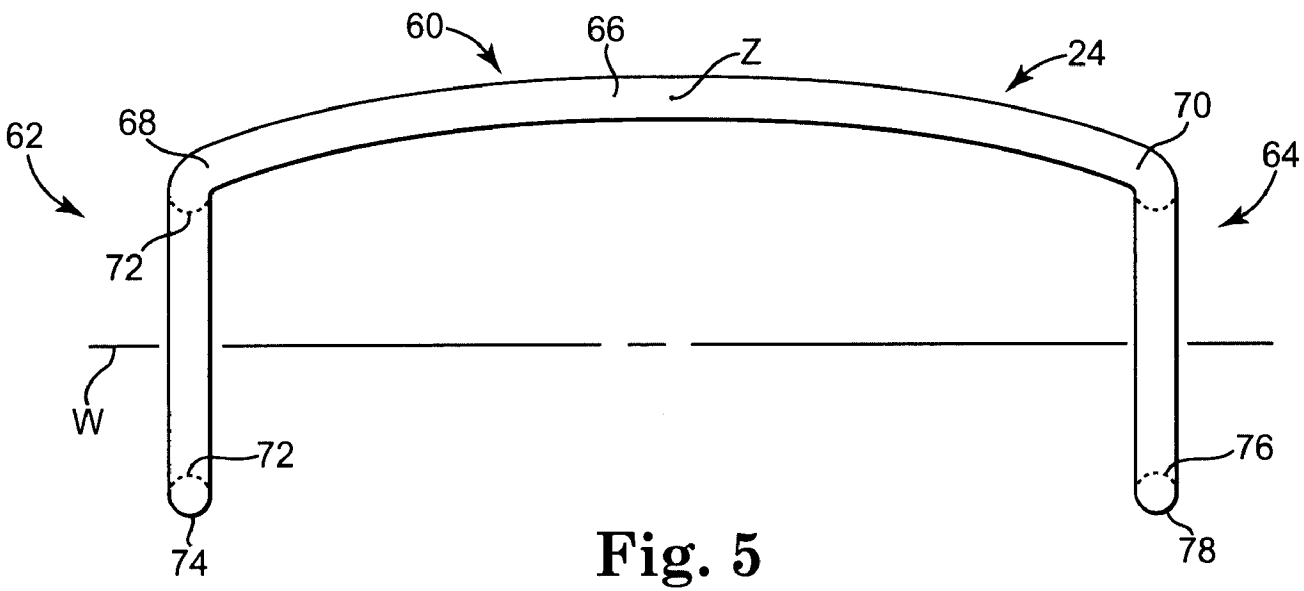
FIG. 5 is a front view of the strap of FIG. 4, according to an embodiment of the present invention.
Figure 6:
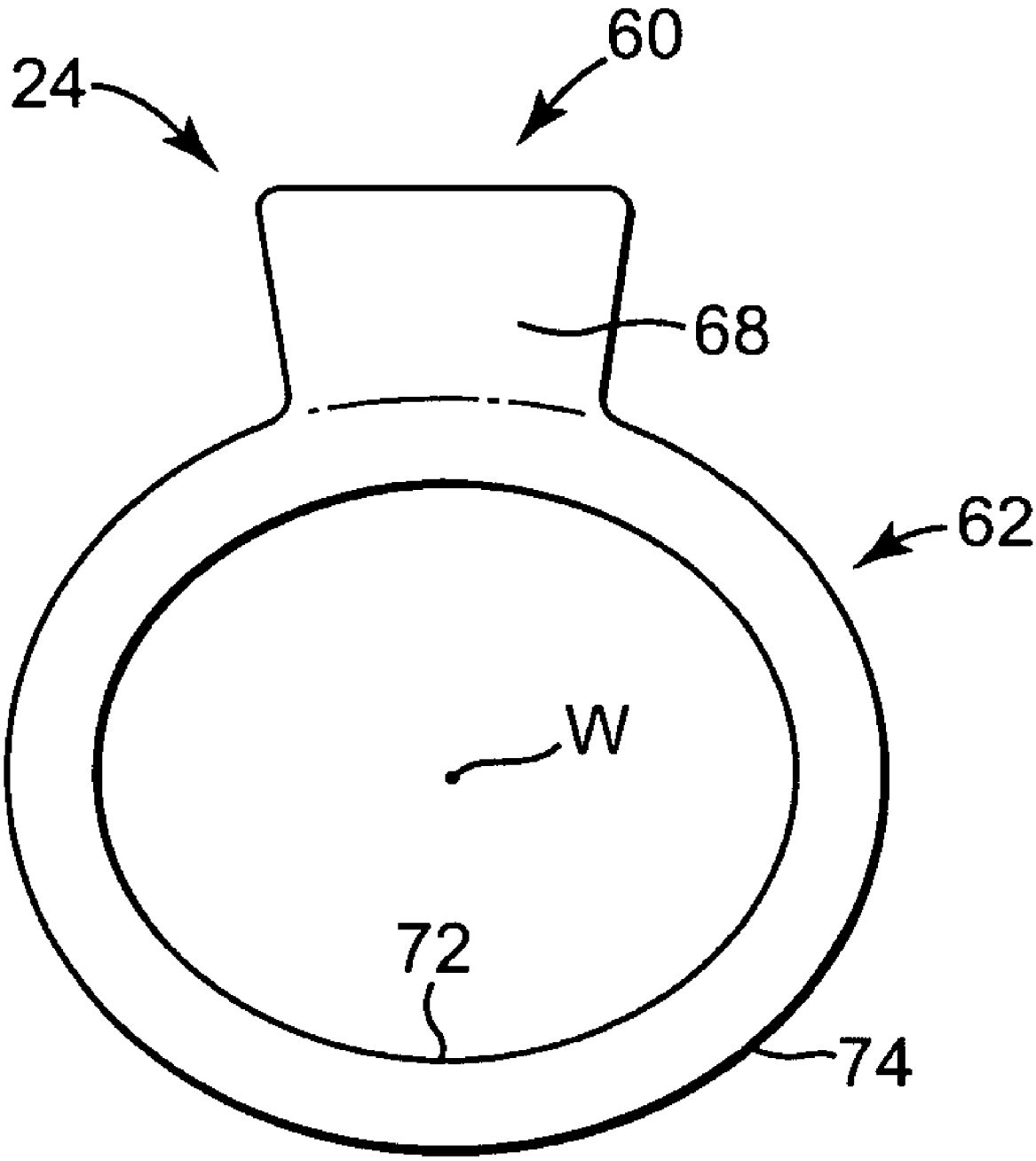
FIG. 6 is a side view of the strap of FIG. 4, according to an embodiment of the present invention.

FIG. 5 shows the strap 24 from a front view. The first coupling portion 62 extends substantially vertically from the first end portion 68 and defines a common centerline W with the second coupling portion 64. However, it should be understood that the first coupling portion 62 optionally extends from the first end portion 68 at a variety of angles. Turning to FIG. 6, the first coupling portion 62 defines a substantially annular and oval-shaped side profile transverse to the common centerline W. However, the first coupling portion 62 optionally defines a substantially annular and circular-shaped transverse profile. Regardless, the first coupling portion 62 defines an inner surface 72 and an outer surface 74, wherein the inner surface 72 defines an inner diameter and the outer surface 74 defines an outer diameter of the first coupling portion 62. As shown by the dotted lines in FIG. 5, the inner surface 72 is substantially rounded. In particular, the inner surface 72 is substantially complementary in shape to the base 42 of the annular groove 40 associated with the first end weight 28.

The second coupling portion 64 extends substantially vertically from the second end portion 70 and defines the common centerline W with the first coupling portion 62, as described above. However, it should be understood that the second coupling portion 64 optionally extends from the second end portion 70 at a variety of angles. While obscured by the first coupling portion 62 in FIG. 6, the second coupling portion 64 also defines a substantially annular and oval-shaped side profile transverse to the common centerline W. However, the second coupling portion 64 optionally defines a substantially annular, circular-shaped transverse profile. Regardless, the second coupling portion 64 defines an inner surface 76 and an outer surface 78, wherein the inner surface 76 defines an inner diameter and the outer surface 78 defines an outer diameter of the second coupling portion 64. As shown by the dotted lines in FIG. 5, the inner surface 76 is substantially rounded. In particular, the inner surface 76 is substantially complementary in shape to the base 48 of the annular groove 46 associated with the second end weight 30.

Figure 7:
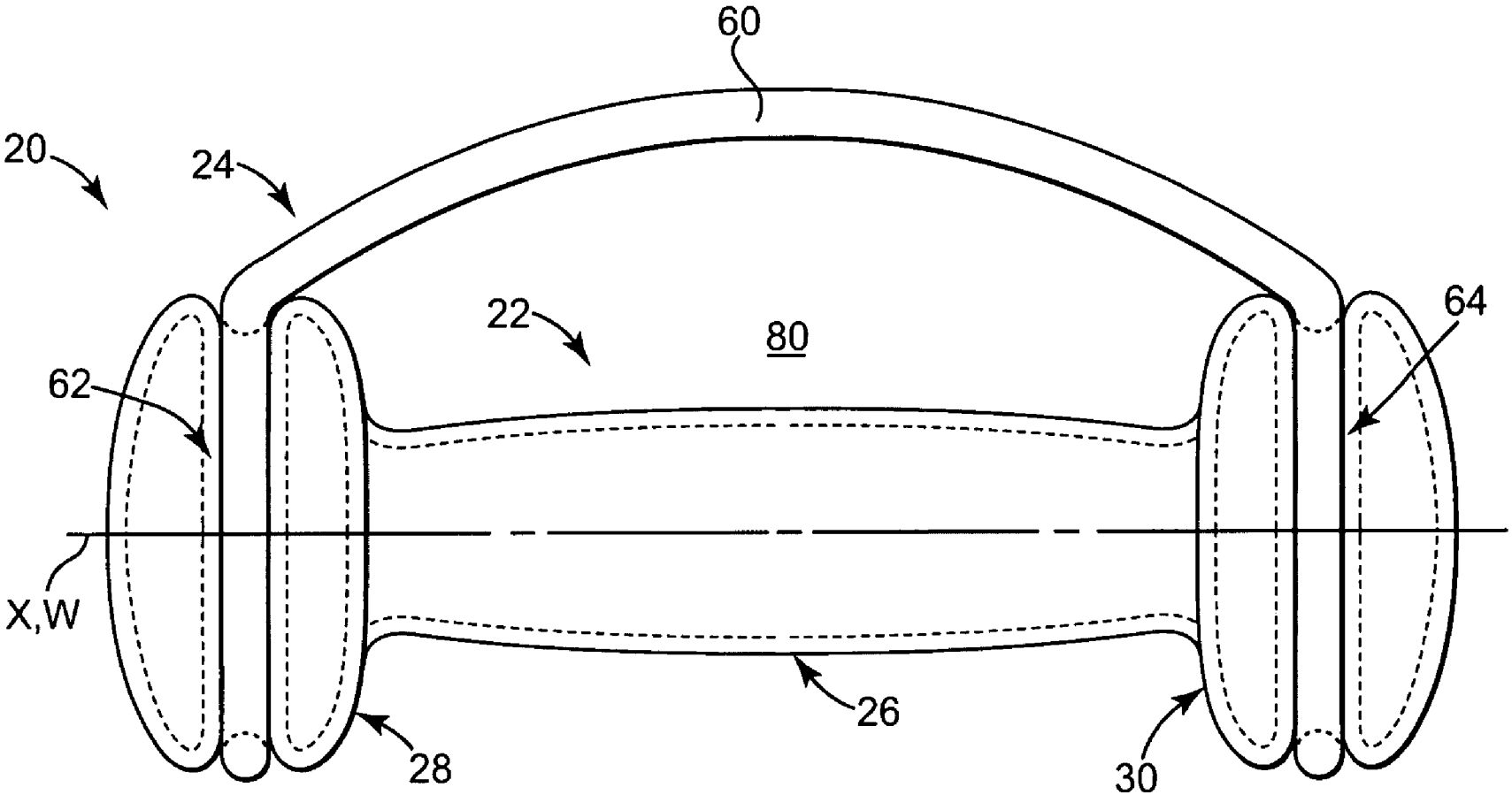
FIG. 7 is a front view of the dumbbell assembly of FIGS. 1A and 1B, according to an embodiment of the present invention.

FIG. 7 shows the strap 24 assembled to the dumbbell 22. To accomplish the dumbbell assembly 20, the first coupling portion 62 is elastically stretched, or deformed. The inner surface 72 (FIG. 5) is then slid over the maximum outer diameter of the first end weight 28 to dispose the first coupling portion 62 about the first end weight 28. In particular, the inner surface 72 is seated against the base 42 (FIG. 2) of the annular groove 40 (FIG. 2) in an elastic and complementary fit. The rounded transition between the mouth 44 (FIG. 2) and the inner and outer portions 28*a*, 28*b* (FIG. 2) of the first end weight 28 facilitate slipping the first coupling portion 62 into the annular groove 40. So assembled, the common centerline W of the first coupling portion 62 is coaxially disposed with the longitudinal centerline X of the dumbbell 22. In this manner, the dumbbell assembly 20 provides means for elastically and removably securing the first coupling portion 62 about the first end weight 28 of the dumbbell 22.

The second coupling portion 64 is elastically stretched, or deformed, such that the inner surface 76 (FIG. 5) is slidable over the maximum outer diameter of the second end weight 30 to ultimately dispose the second coupling portion 64 about the second end weight 30. In particular, the inner surface 76 is seated against the base 48 (FIG. 2) of the annular groove 46 (FIG. 2) in a complementary fit. The rounded transition between the mouth 50 (FIG. 2) and the inner and outer portions 30*a*, 30*b* (FIG. 2) of the second end weight 30 facilitate slipping the second coupling portion 64 into the annular groove 46. So assembled, the common centerline W of the second coupling portion 64 is coaxially disposed with the longitudinal centerline X of the dumbbell 22. In this manner, the dumbbell assembly 20 provides means for elastically and removably securing the second coupling portion 64 about the second end weight 30 of the dumbbell 22.

With the first and second coupling portion 62, 64 of the strap 24 arranged over the first and second end weights 28, 30 of the dumbbell 22, the strap 24 and the handle 26 of the dumbbell 22 define a space 80 configured to receive a hand (not shown). The central band 60 of the strap 24 extends arcuately and outwardly from the longitudinal centerline X of the dumbbell 22. However, the central band 60 of the strap 24 optionally extends substantially parallel to the longitudinal centerline X to define the space 80.

While exercising or otherwise using the dumbbell assembly 20, a user (not shown) grasps the dumbbell assembly 20 by placing a hand of the user into the space 80 with a palm of the hand against the handle 26 and a back of the hand against the strap 24. This arrangement facilitates a secure grip by the user and reduces a risk of inadvertently dropping the dumbbell 22 during exercise. For example, if the user desires to use the dumbbell 22 while walking, the strap 24 is assembled to the dumbbell 22 to ensure a better grip. If the user desires to use the dumbbell 22 in association with a more stationary, "floor" exercise, such as aerobics or stretching exercises, the strap 24 is removed. Additionally, the oval-shaped, or "egg-shaped," side profile and covexo-convex, or tapered front profile defined by the handle 26 of the dumbbell 22 provide an ergonomic and comfortable palm grip for the user. It should also be readily understood that a second, substantially similar dumbbell assembly (not shown) is provided to a user desiring a "pair" of dumbbell assemblies (not shown).

Additionally, when placed on the ground or any relatively horizontal surface (not shown), the oval-shaped side profile defined by the first and second end weights 28, 30 reduces a possibility that the dumbbell 22 will roll away from a spot where the dumbbell 22 has been laid. With the strap 24 assembled to the dumbbell 22, the oval-shaped side profile of the first and second end weights 28, 30 results in dumbbell assembly 20 naturally resting with the major axis M parallel to the horizontal surface in a "handle up" position.

Figure 8:
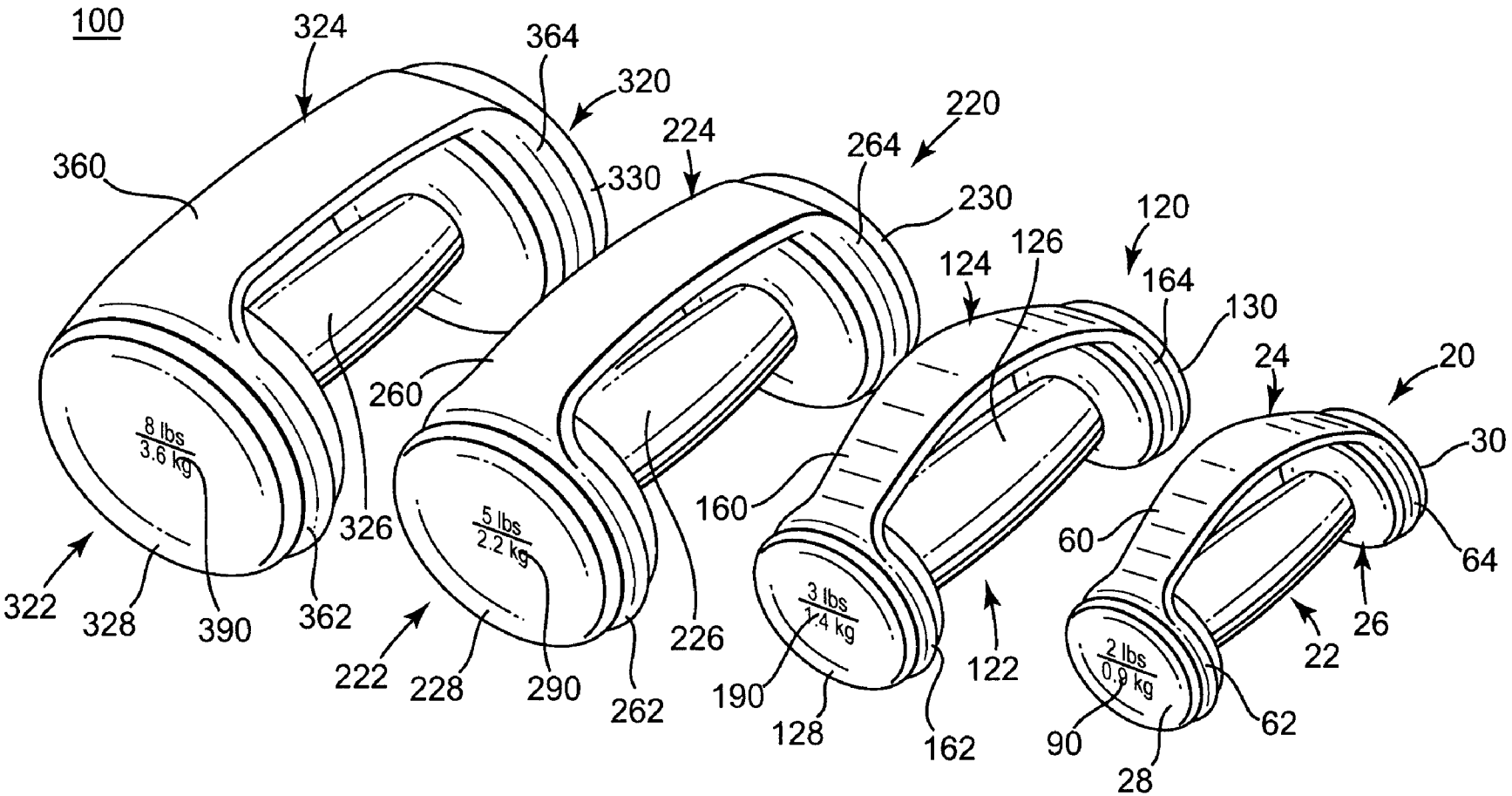
FIG. 8 is a perspective view of a dumbbell assembly kit, according to an embodiment of the present invention.

FIG. 8 shows a perspective view of a dumbbell assembly kit 100. The kit 100 includes a plurality of dumbbell assemblies, the plurality including the dumbbell assembly 20, a second dumbbell assembly 120, a third dumbbell assembly 220, and a fourth dumbbell assembly 320. Each of the dumbbell assemblies 20, 120, 220, 320 includes a dumbbell 22, 122, 222, 322 and a strap 24, 124, 224, 324. Each of the dumbbells 22, 122, 222, 322 includes a handle 26, 126, 226, 326, a first end weight 28, 128, 228, 328, and a second end weight 30, 130, 230, 330 and has an associated weight with indicia 90, 190, 290, 390 corresponding to the associated weight. Each of the straps 24, 124, 224, 324 includes a center portion 60, 160, 260, 360, a first coupling portion 62, 162, 262, 362, and a second coupling portion 64, 164, 264, 364. Furthermore, the first and second coupling portions 62, 162, 262, 362, 64, 164, 264, 364 are disposed over the first and second end weights 28, 128, 228, 328, 30, 130, 230, 330, respectively, according to the principles previously described in association with the dumbbell assembly 20.

The handles 26, 126, 226, 326 are substantially similar in size and shape, graduating slightly in size. The first and second end weights 28, 128, 228, 328, 30, 130, 230, 330 increase in size such that the dumbbells 22, 122, 222, 322 have graduating weights. In particular, the dumbbell 22 has a weight of about 2 pounds, the second dumbbell 122 has a weight of about 3 pounds, the third dumbbell 222 has a weight of about 5 pounds, and the fourth dumbbell 322 has a weight of about 8 pounds, although other weights are equally acceptable.

It should also be noted that the central bands 60, 160, 260, 360 of the straps 24, 124, 224, 324 curve or arc away from the handles 26, 126, 226, 326, to lesser extents as the dumbbells 22, 122, 222, 322 graduate in weight. For example, the central band 60 defines a relatively large arc as compared to a relatively flat extension defined by the central band 360. Additionally, it should be understood that the first and second coupling portions 62, 162, 262, 362, 64, 164, 264, 364 graduate in size in proportion to graduations in size of the first and second end weights 28, 128, 228, 328, 30, 130, 230, 330, respectively.

In this manner, a graduated "set" of weights is provided, all capable of incorporating the advantages described above. Furthermore, it should be readily understood that each of the dumbbell assemblies 20, 120, 220, 320, respectively are accompanied with a substantially similar "partner" such that a pair of dumbbells is provided at each weight graduation.

Although the invention has been described with respect to particular embodiments, such embodiments are for illustrative purposes only and should not be construed to limit the invention. Various alternatives and changes will be apparent to those of ordinary skill in the art. For example, although disclosed above as being formed in a particular shape or of a particular size, other suitable shapes and sizes of hand weights are also contemplated. Other modifications within the scope of the invention and its various embodiments will be apparent to those of ordinary skill.

What is claimed is:

1. A dumbbell assembly comprising:

a dumbbell comprising:

a substantially elongate handle defining a first end portion and a second end portion opposing the first end portion, the handle defining a maximum handle diameter;

a first end weight connected to the first end portion of the handle, the first end weight defining a maximum first end weight diameter greater than the maximum handle diameter and having a first annular groove transversely encircling an outer circumference of the first end weight; and a second end weight connected to the second end portion of the handle, the second end weight defining a maximum second end weight diameter greater than the maximum handle diameter and having a second annular groove transversely encircling an outer circumference of the second end weight; and a strap continuously formed of an elastomeric material as a single piece, the strap comprising:

a central band defining a first end portion and a second end portion opposing the first end portion;

a first coupling portion connected to the first end portion of the central band; and a second coupling portion connected to the second end portion of the central band;

wherein the first coupling portion transversely encircles the first end weight and is elastically secured in the first annular groove and the second coupling portion transversely encircles the second end weight and is elastically secured in the second annular groove.

2. The dumbbell assembly of claim 1, wherein the strap is deformable such that the first and the second coupling portions are removably secured about the first and the second end weights, respectively.

3. The dumbbell assembly of claim 1, wherein the dumbbell is continuously formed as a single piece.

4. The dumbbell assembly of claim 1, further comprising:

a substantially compliant outer cover continuously formed about an entirety of the dumbbell.

5. The dumbbell assembly of claim 1, wherein each of the annular grooves defines a mouth having rounded edges.

6. The dumbbell assembly of claim 1, wherein the central band tapers in width toward the first and the second end portions of the central band.

7. The dumbbell assembly of claim 1, wherein the handle of the dumbbell defines a longitudinal centerline, and further wherein the central band of the strap arcs outwardly from the longitudinal centerline of the handle.

8. The dumbbell assembly of claim 1, wherein the handle tapers in diameter toward the first and the second end portions of the handle.

9. The dumbbell assembly of claim 1, wherein each of the first and second end weights defines a substantially oval-shaped transverse cross-section.

10. The dumbbell assembly of claim 1, wherein the first end weight has an annular groove formed in the outer circumference of the first end weight, the groove of the first end weight adapted to receive the first coupling portion of the strap and the second end weight has an annular groove formed in the outer circumference of the second end weight, the groove of the second end weight adapted to receive the second coupling portion.

11. A method of assembling and using a hand weight assembly, the method comprising:

deforming a first deformable cuff of a hand band, the hand band including an elongate strap extending between the first deformable cuff and a second deformable cuff opposing the first deformable cuff;

disposing the first deformable cuff of the hand band completely around a first lobe of a hand weight such that it is releasably secured around the first lobe, the hand weight including a bar extending between the first lobe and a second lobe opposing the first lobe, the first lobe defining a maximum first lobe diameter and the second lobe defining a maximum second lobe diameter, the maximum first lobe diameter and the maximum second lobe diameter greater than a maximum diameter of the bar, wherein the maximum first lobe diameter and the maximum second lobe diameter define a major axis of the first and second lobes;

deforming the second deformable cuff of the hand band;

disposing the second deformable cuff of the hand band completely around the second lobe such that it is releasably secured around the second lobe;

wherein disposing the first deformable cuff about the first lobe includes sliding the first deformable cuff over the maximum first lobe diameter and disposing the second deformable cuff about the second lobe includes sliding the second deformable cuff over the maximum second lobe diameter; and placing the hand weight assembly on a substantially horizontal surface with the major axis of the first and second lobes being substantially non-parallel relative to the substantially horizontal surface, wherein the hand weight assembly naturally rotates to rest with the major axis parallel to the substantially horizontal surface and the hand band in a substantially upright position.

12. The method of claim 11, wherein an annular groove is formed about the first lobe of the hand weight, the first deformable cuff maintained in the annular groove of the first lobe, and wherein an annular groove is formed about the second lobe of the hand weight, the second deformable cuff maintained in the annular groove of the second lobe.

13. The method of claim 11, wherein the hand weight is formed as a single, continuous piece.

14. A hand held exercise implement comprising:

a first coupling portion of a hand band removably secured around a first lobe of a dumbbell by slipping the first coupling portion over a maximum outer circumference of the first lobe, the first lobe including an inner portion, an outer portion, and a first annular groove between the inner and outer portions, the first annular groove being formed about an outer circumference of the first lobe and defining a mouth having rounded edges that form a rounded transition from the inner and outer portions of the first lobe into the first annular groove; and a second coupling portion of the hand band removably secured around a second lobe of the dumbbell by slipping the second coupling portion over a maximum outer circumference of the second lobe, the second lobe including an inner portion, an outer portion, and a second annular groove between the inner and outer portions, the second annular groove being formed about an outer circumference of the second lobe and defining a mouth having rounded edges that form a rounded transition from the inner and outer portions of the second lobe into the second annular groove;

wherein the first and the second lobes define a larger outer circumference than a handle portion of the dumbbell.

15. The hand held exercise implement of claim 14, wherein a substantially continuous outer layer covers an entirety of the dumbbell.

16. The hand held exercise implement of claim 14, wherein the dumbbell is continuously formed as a single piece.

17. The hand held exercise implement of claim 14, wherein the first lobe of the dumbbell includes a circumferential groove formed in the first lobe, the circumferential groove adapted to secure the first coupling portion about the first lobe.

18. The hand held exercise implement of claim 14, wherein the first coupling portion of the hand band is formed of an elastic material for stretching and slipping the first coupling portion of the hand band over the first lobe of the dumbbell.

19. A hand weight assembly comprising:

a dumbbell comprising:

a substantially elongate handle defining a substantially oval-shaped transverse cross-section, the handle including a middle portion, a first end portion and a second end portion opposing the first end portion, the handle defining a maximum handle diameter at the middle portion and tapering in diameter toward each of the first and second end portions;

a first end weight connected to the first end portion of the handle, the first end weight defining a substantially oval-shaped transverse cross-section and a maximum first end weight diameter greater than the maximum handle diameter, the first end weight including an annular groove formed about an outer circumference of the first end weight; and a second end weight connected to the second end portion of the handle, the second end weight defining a substantially oval-shaped transverse cross-section and a maximum second end weight diameter greater than the maximum handle diameter, the second end weight including an annular groove formed about an outer circumference of the second end weight; and a strap that is continuously formed of an elastomeric material as a single piece, the strap comprising:

a central band defining a first end portion and a second end portion opposing the first end portion;

a first coupling portion connected to the first end portion of the central band, the first coupling portion being substantially elastically deformable and defining a substantially annular transverse cross-section; and a second coupling portion connected to the second end portion of the central band, the second coupling portion being substantially elastically deformable and defining a substantially annular transverse cross-section;

wherein the first coupling portion is removably secured around the oval-shaped transverse cross-section and in the annular groove of the first end weight and the second coupling portion is removably secured around the oval-shaped transverse cross-section and in the annular groove of the second end weight.

20. The hand weight assembly of claim 19, wherein the strap is formed of an elastomeric material.

* * * * *